US005222378A

United States Patent [19]

Chuan

[11] Patent Number: 5,222,378

[45] Date of Patent: Jun. 29, 1993

[54] FILTER/SEPARATOR FOR A VEHICLE AIR CONDITIONING SYSTEM

[76] Inventor: Pan C. Chuan, 4th Fl., No. 3, Alley 4, Lane 292, Chihhsing Rd., Taipei, Taiwan

[21] Appl. No.: 804,067

[22] Filed: Dec. 9, 1991

[51] Int. Cl.[5] ..... F25B 43/00

[52] U.S. Cl. ..... 62/474; 62/113; 62/503

[58] Field of Search ..... 62/474, 503, 512, 85, 62/113

[56] References Cited

U.S. PATENT DOCUMENTS

| | | | |
|---|---|---|---|
| 1,746,406 | 2/1930 | Sawyer | 62/503 |
| 1,839,350 | 1/1932 | Slagel | 62/474 |
| 2,504,184 | 4/1950 | Dawson | 62/474 |
| 2,786,340 | 3/1957 | Chausson | 62/474 |
| 3,118,288 | 1/1964 | Small | 62/474 |
| 3,212,289 | 10/1965 | Bottum | 62/503 |
| 3,810,366 | 5/1974 | Orth | 62/217 |
| 4,354,362 | 10/1982 | Schumacher | 62/474 |

*Primary Examiner*—Albert J. Makay
*Assistant Examiner*—William Doerrler
*Attorney, Agent, or Firm*—William E. Pelton

[57] ABSTRACT

A filter/separator for a vehicle air conditioning system includes an outer container and an inner container. A first chamber is defined between the outer and inner containers. A second chamber is defined by the inner container. The first chamber is filled with the coolant. An inlet is formed in a wall of the outer container, communicating a condenser with the first chamber. A first tube extends in and through a wall of the inner container with a first end thereof located in the first chamber and a second end thereof communicating with an expansion valve. A filter is provided in the first chamber between the inlet and the first end of the first tube for filtering water and other undesired articles carried by the coolant. A second tube has a first end communicating with an evaporator and a second end in the second chamber. A substantially hook-like separation tube is provided in the inner container with a first end thereof in a lower portion of the second chamber and a second end thereof communicating with a compressor. An aperture is formed on a lowermost portion of the separation tube through which liquid gas is passable to the second chamber.

3 Claims, 2 Drawing Sheets

FILTER/SEPARATOR FOR A VEHICLE AIR CONDITIONING SYSTEM

BACKGROUND OF THE INVENTION

The present invention relates to a filter/separator for a vehicle air conditioning system, and more particularly to a filter/separator which functions as a filter and as a separator as well.

A conventional air conditioning system for vehicles includes a compressor, a condenser with a cooling fan, a filter for filtering water and other undesired articles contained in coolant, an expansion valve, an evaporator, a blower, and a separator installed between the compressor and the condenser for separation of gaseous coolant and liquid coolant to prevent liquid coolant from entering into the compressor. Nevertheless, the lowering of temperature of the coolant leaving the compressor by the cooling fan of the condenser is not efficient. In addition, the filter is installed in an engine hood which is exposed to a high-temperature environment, rendering the temperature in the filter to be higher than atmospheric temperature. Accordingly, the temperature of coolant cannot be efficiently and effectively lowered, resulting in bad air conditioning, inefficient compressor operation, and energywaste.

The present invention provides a filter/separator to mitigate and/or obviate the aforementioned problems.

SUMMARY OF THE INVENTION

A filter/separator according to the present invention includes an outer container and an inner container in the outer container. A first chamber is defined between the outer and inner containers and a second chamber is defined by the inner container. The first chamber is filled with coolant. An inlet is formed in a wall of the outer container, communicating a condenser with the first chamber. A first tube extends in and through a wall of the inner container with a first end located in the first chamber and a second end communicating with a expansion valve. A filtering means is provided in the first chamber between the inlet and the first end of the first tube for filtering water and other undesired articles carried by the coolant.

A second tube is provided in the inner container with a first end communicating with an evaporator and a second end in the second chamber. A substantially hook-like separation tube is also provided in the inner container with a first end in a lower portion of the second chamber and a second end communicating with a compressor. An aperture is formed on a lowermost portion of the separation tube through which liquid gas is passable to a bottommost portion of the second chamber.

After leaving the evaporator, gaseous coolant passes through the separation tube and exits the second chamber via the second end of the separation tube. Liquid coolant leaks back to the second chamber and absorbs heat from the wall of the second chamber, becoming gaseous, and then exiting the second chamber via the separation tube 22.

Heat exchange occurs at the wall of the second chamber, such that the temperature of coolant in the first chamber decreases further and the temperature of coolant in the second chamber increases further. The temperature of coolant entering the expansion valve is lowered, while the temperature of coolant entering the compressor increases, rendering an increase in heat efficiency.

Accordingly, it is a primary object of the present invention to provide a filter/separator which further lowers the temperature of coolant before it enters into an expansion valve.

Another object of the present invention is to provide a filter/separator which increases the temperature of coolant before it enters into a compressor.

A further object of the present invention is to provide a compact and inexpensive design for vehicle air conditioning system.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
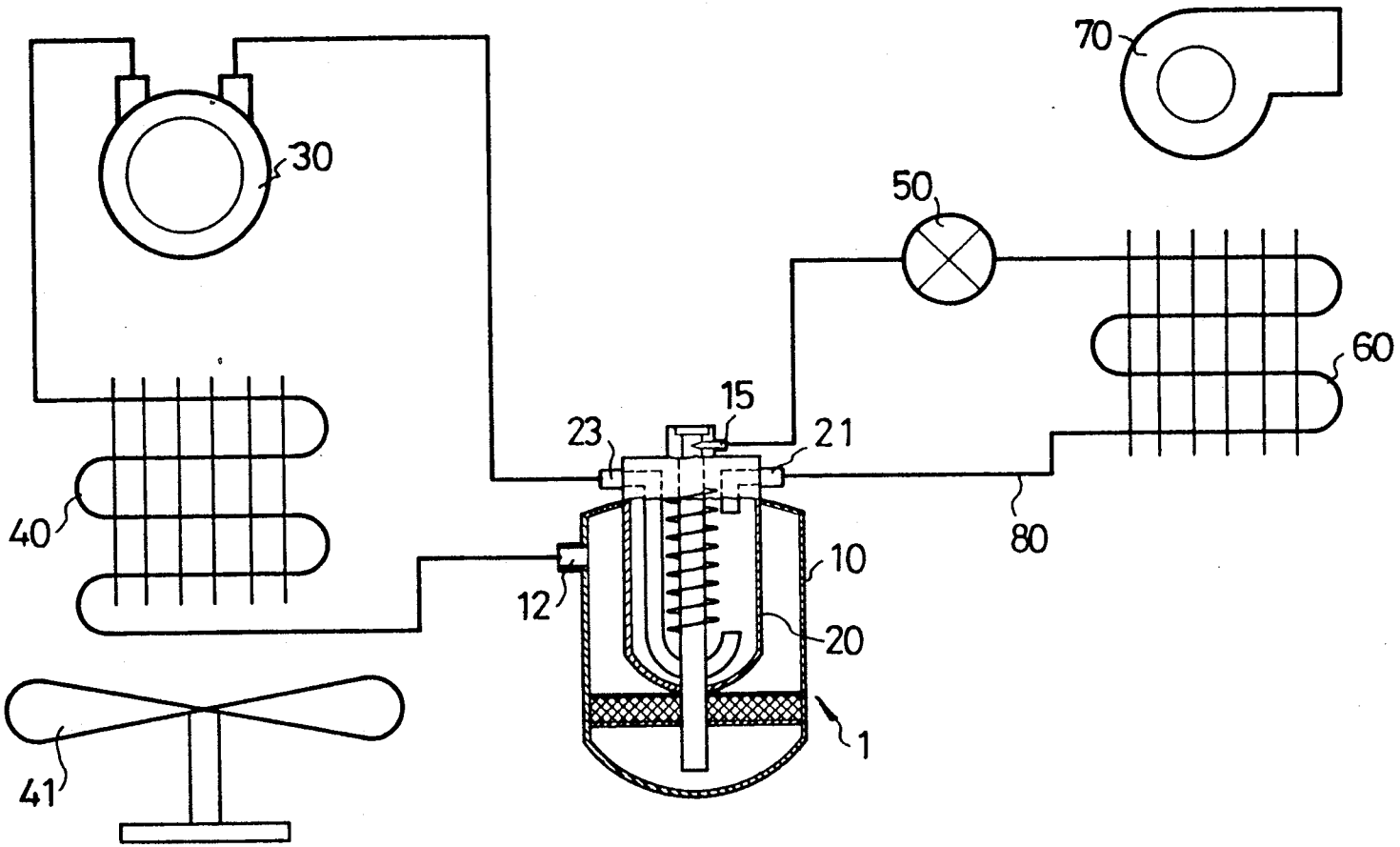
FIG. 1 is a schematic view, partly in section, of a vehicle air conditioning system utilizing a filter/separator in accordance with the present invention.

Referring to FIG. 1, a vehicle air conditioning system utilizing a filter/separator 1 according to the present invention includes a compressor 30, a condenser 40 with a cooling fan 41, the filter/separator 1, an expansion valve 50, an evaporator 60, a blower 70 for feeding fresh air, and piping 80 for connecting the above units and for receiving coolant.

Figure 2:
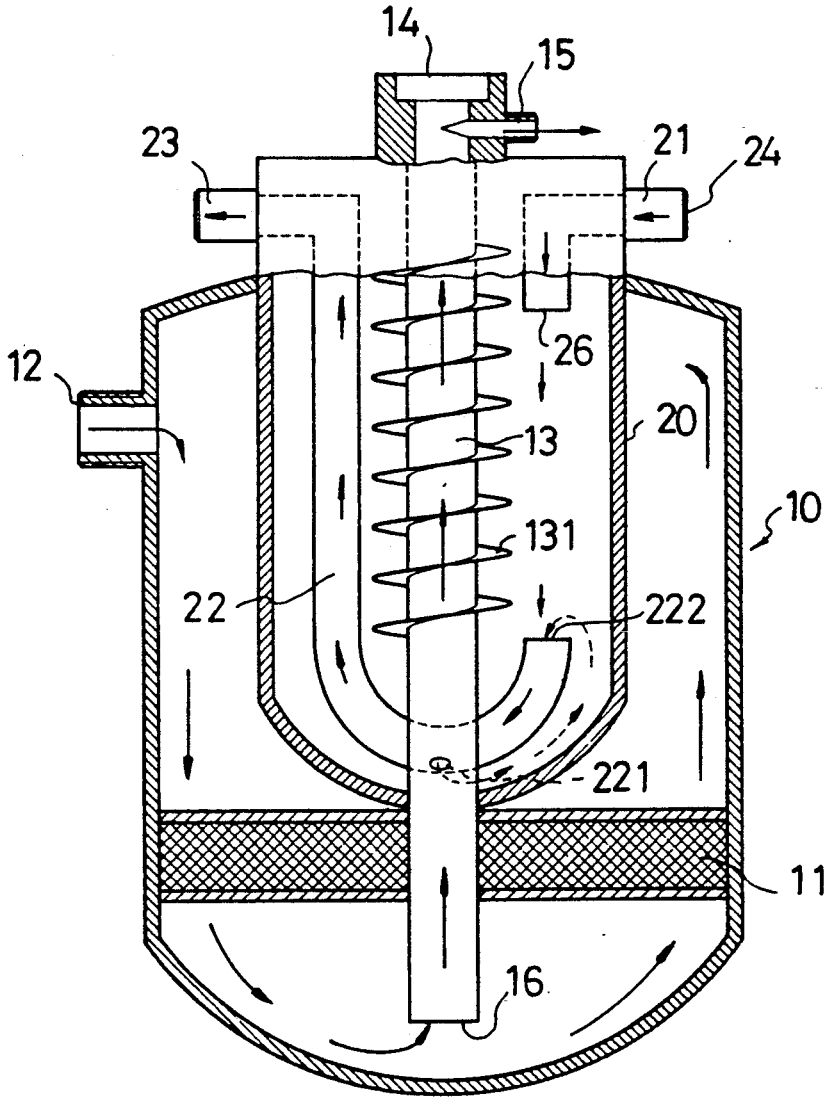
FIG. 2 is a cross-sectional view of the filter/separator in accordance with the present invention.

Referring to FIG. 2, the filter/separator 1 includes an outer container 10 and an inner container 20. A first chamber is defined between the outer and inner containers 10 and 20 and a second chamber is defined by the inner container 20. The first chamber is filled with coolant, which will be discussed later. An inlet 12 is formed in a wall of the outer container 10, communicating the condenser 40 with the first chamber. A first tube 13 extends in and through a wall of the inner container 20 with a first end 16 located in the first chamber and a second end 15 communicating with the expansion valve 50. A plurality of radiating fins 131 are formed on an outer periphery of the tube 13 which will be described in more detail later. A filtering means 11 is provided in the first chamber between the inlet 12 and the first end 16 of the first tube 13 for filtering water and other undesired articles carried by the coolant.

A second tube 21 is provided in the inner container 20 with a first end 24 communicating with the evaporator 60 and a second end 13 in the second chamber. A substantially hook-like separation tube 22 is also provided in the inner container 20 with a first end 222 in a lower portion of the second chamber and a second end 23 communicating with the compressor 30. An aperture 221 is formed on a lowermost portion of the separation tube 22 through which liquid gas is passable to a bottom portion of the second chamber, which will be discussed later. Optionally, a gauge means 14 can be provided on top of the first tube 13 for inspecting the pressure of coolant.

In operation, coolant leaving the compressor is at high temperature and high pressure. After passing through the condenser 40, the temperature of the coolant is lowered under the aid of the cooling fan 41, but the pressure remains the same. The coolant then enters the first chamber via the inlet 12 and thus fills the first chamber, in which water and other undesired articles carried by the coolant are filtered by the filtering means 11. Thereafter, the coolant exits the filter/separator 1 via the first tube 13 to the evaporator 50, at which the coolant turns into low-pressure and low-temperature liquid (see long arrows in FIG. 2). Subsequently, the coolant passes through the evaporator 60 at which the coolant absorbs the heat of fresh air to be fed into the vehicle and becomes gaseous coolant at high temperature and low pressure.

The coolant then enters the second chamber via the second tube 21. Gaseous coolant passes through the separation tube 22 and exits the second chamber via the second end 23 (see short arrows in FIG. 2). Liquid coolant leaks back to the second chamber and absorbs heat from the wall of the second chamber, turning into gaseous coolant and then exiting the second chamber via the separation tube 22 (see broken lines in FIG. 2).

Such a process runs continuously, and it is noted that coolant in the first chamber undergoes a heat exchange with coolant in the second chamber. Although the temperature of coolant in the first chamber is relatively "low" in comparison with the temperature of coolant from the compressor, it is still higher than the temperature of coolant entering the second chamber from the evaporator. Accordingly, heat exchange occurs at the wall of the second chamber, such that the temperature of coolant in the first chamber decreases further and the temperature of coolant in the second chamber increases further. Radiating fins 131 on the first tube 13 further facilitate the heat dissipation of the coolant. It is clear that the temperature of coolant entering the expansion valve is lowered, while the temperature of coolant entering the compressor is increased, rendering an increase in heat efficiency. Furthermore, the separator and the filter in conventional designs are successfully combined in the present invention, providing a compact and inexpensive design.

Although the invention has been explained in relation to its preferred embodiment, it is to be understood that many other possible modifications and variations can be made without departing the spirit and scope of the invention as hereinafter claimed.

I claim:

1. A filter/separator for a vehicle air conditioning system comprising a compressor, a condenser, an expansion valve, an evaporator, a blower for feeding fresh air, and piping for connecting said filter/separator, said compressor, said condenser, said expansion valve, and said evaporator and for receiving coolant, said filter/separator comprising:

an outer container and an inner container, a first chamber being defined between said outer and inner containers, a second chamber being defined by said inner container, said first chamber being filled with said coolant;

an inlet being formed in a wall of said outer container and communicating said condenser with said first chamber, a first tube extending in and through a wall of said inner container with a first end thereof located in said first chamber and a second end thereof communicating with said expansion valve, a filtering means being provided in said first chamber between said inlet and said first end of said first tube for filtering water and other undesired articles carried by said coolant;

a second tube having a first end communicating with said evaporator and a second end in said second chamber, a substantially hook-like separation tube being provided in the inner container with a first end thereof in a lower portion of said second chamber and a second end thereof communicating with said compressor, an aperture being formed on a lowermost portion of said separation tube through which liquid gas is passable to said second chamber.

2. The filter/separator as claimed in claim 1, further comprising a plurality of radiating fins formed on an outer periphery of said first tube for facilitating heat dissipation of said coolant passing therethrough.

3. The filter/separator as claimed in claim 1, further comprising an indicating means provided on top of said first tube for inspecting pressure of said coolant.

* * * * *